US007261216B2

(12) United States Patent
Becker et al.

(10) Patent No.: US 7,261,216 B2
(45) Date of Patent: Aug. 28, 2007

(54) RECLOSABLE METAL BEVERAGE CAN

(75) Inventors: Gordon P. Becker, Bentleyville, OH (US); John Sorensen, Gananoque (CA)

(73) Assignee: Novelis, Inc., Toronto, Ontario (CA)

( * ) Notice: Subject to any disclaimer, the term of this patent is extended or adjusted under 35 U.S.C. 154(b) by 410 days.

(21) Appl. No.: 10/894,928

(22) Filed: Jul. 19, 2004

(65) Prior Publication Data

US 2004/0256346 A1 Dec. 23, 2004

Related U.S. Application Data

(63) Continuation of application No. 10/241,963, filed on Sep. 11, 2002, now abandoned.

(51) Int. Cl.
*B65D 41/04* (2006.01)

(52) U.S. Cl. ..... 215/329; 215/44; 215/355

(58) Field of Classification Search ..... 220/796, 220/799, 259.3, 790, 789; 222/568, 570; 215/44, 329, 355
See application file for complete search history.

(56) References Cited

U.S. PATENT DOCUMENTS

| | | | | |
|---|---|---|---|---|
| 2,763,403 | A | 9/1956 | Livingstone | |
| 2,916,311 | A | 12/1959 | Keplinger | |
| 3,071,281 | A | 1/1963 | Sawai | |
| 3,110,411 | A | 11/1963 | Golde | 220/39 |
| 3,167,202 | A * | 1/1965 | Tolciss | 215/307 |
| 3,358,875 | A * | 12/1967 | Ekstrom | 220/789 |
| 3,656,668 | A * | 4/1972 | Liebertz | 222/570 |
| 3,680,745 | A * | 8/1972 | Landen | 222/570 |
| 3,700,133 | A * | 10/1972 | Bagguley | 215/221 |
| 4,299,330 | A | 11/1981 | Walter | |
| 4,310,102 | A | 1/1982 | Walter | |
| 4,452,368 | A | 6/1984 | Roth | |
| 4,466,553 | A | 8/1984 | Zenger | |
| 4,682,707 | A * | 7/1987 | Wiles | 220/789 |
| 4,809,870 | A | 3/1989 | Goodall | |
| 4,909,434 | A | 3/1990 | Jones et al. | |
| 5,379,910 | A | 1/1995 | Montgomery | |
| 5,971,180 | A * | 10/1999 | Wu | 215/228 |
| 6,010,026 | A | 1/2000 | Diekhoff et al. | |
| 6,196,451 | B1 * | 3/2001 | Helms | 229/125.13 |
| 7,014,060 | B2 | 3/2006 | Richardson | 220/288 |

FOREIGN PATENT DOCUMENTS

| | | |
|---|---|---|
| DE | 35 36 741 | 7/1987 |
| DE | 198 02 953 | 7/1999 |
| EP | 0 814 029 A1 | 12/1997 |
| FR | 1406289 | 7/1965 |
| FR | 2088530 | 1/1972 |
| FR | 2 831 874 | 5/2003 |
| WO | WO97/47530 | 12/1997 |
| WO | WO99/10242 | 3/1999 |

* cited by examiner

*Primary Examiner*—Anthony D. Stashick
*Assistant Examiner*—James Smalley
(74) *Attorney, Agent, or Firm*—Cooper & Dunham LLP

(57) ABSTRACT

A thin wall metal beverage can is described having a converging shoulder portion merging into a neck portion, the top edge of which is folded to form a flange providing an annular abutment and with a threaded sleeve sliding into the neck portion, the sleeve having an annular rib or catch which snaps over the flange abutment holding the sleeve and can neck portion against relative axial movement.

1 Claim, 2 Drawing Sheets

RECLOSABLE METAL BEVERAGE CAN

CROSS REFERENCE TO RELATED APPLICATION

This application is a continuation of U.S. patent application Ser. No. 10/241,963, filed Sep. 11, 2002, now abandoned.

BACKGROUND OF THE INVENTION

1. Field of the Invention

This invention relates to thin wall metal beverage cans, and in particular to aluminum beverage cans having a threaded neck portion for receiving a threaded closure cap to seal the contents of the container.

2. Description of the Prior Art

Aluminum cans are now widely used in the packaging of beer, soft drinks, etc. and these are typically adapted to be closed with relatively flat lids or ends. Although the standard aluminum cans offer a number of advantages for the beverage suppliers, such as low cost, excellent barrier properties, recyclability, etc., there is at present a significant interest in reclosable/resealable cans for certain market segments. As an example, beverages supplied at gas stations or convenience stores, are preferably supplied in a reclosable (and preferably resealable) format. As a result, cans are rarely the container of choice at these outlets.

There have been many attempts to design a reclosable can, but so far, market penetration has been very limited. Generally the added cost of such modifications means that the package can only be considered for what are generally referred to as "high-end" beverages. For instance, a type of bottle can has recently been developed for use in the sale of premium beers. Such cans have, however, not penetrated the low cost soft drink market.

In order to be successful, a reclosable can must offer a number of benefits. It must, for instance, provide a shelf life comparable or better than that of the PET bottles. The closure must be easy to use and, ideally, after closing the seal should prevent any further loss of carbonation. Finally, the cost of the package must be acceptable in being no more than only slightly higher than current can costs.

One attempt to provide a can which may be reclosed and resealed is shown in Roth U.S. Pat. No. 4,452,368 issued Jun. 5, 1984.This design has a central plug which is pushed into a pour opening.

Another form of closable beverage can is shown in laid open German Application DE 198 02 953 A1, published Jul. 29, 1999.This design includes punching a hole in the center of the top of the can and fitting into this hole a resealable closure system with a screw cap.

PCT Publication No. WO 99/10242 published Mar. 4, 1999 shows yet another form of resealable can closure making use of a screw cap.

Dickhoff et al. U.S. Pat. No. 6,010,026 issued Jan. 4, 2000 shows a reclosable can that can be produced in a variety of different shapes, all with a threaded top for receiving a threaded closure cap.

It is an object of the present invention to provide an improved form of reclosable and resealable metal can design which functions well while being easy and inexpensive to produce.

SUMMARY OF THE INVENTION

The present invention provides a reclosable metal beverage can made from a thin gauge metal, e.g., an aluminum alloy. The can has a sidewall, a bottom wall, a converging shoulder portion extending upwardly and inwardly from the sidewall and a neck extending upwardly from the top of the shoulder portion. This neck has a top edge portion which is turned either inwardly or outwardly and downwardly to form a flange with a lower edge providing an abutment. A threaded plastic sleeve is mounted in or over the neck. This sleeve is in the form of an open ended tubular member having an annular ledge projecting outwardly from a mid-region of its outer face. The outer face above the projecting ledge is in the form of a threaded portion adapted to receive an internally threaded closure cap. For a sleeve mounted within the neck, the outer face below the projecting ledge has a plurality of axially spaced annular gripping ribs which securely engage the inner face of the can neck. It may also include a lowermost annular catch which engages the flange abutment to hold the sleeve against axial movement relative to the can neck when the can is pressurized.

It has been found to be particularly advantageous to provide at the outer edge of the outwardly projecting ledge a downwardly projecting lip or skirt which extends downwardly and in engagement with the outer face of the can neck. The skirt may optionally engage an abutment surface in the can neck to prevent any expansion of the top portion of the neck when under pressure. In either arrangement, the skirt provides a place to grip the can when the cap is screwed off, preventing the tubular sleeve from possibly rotating in the neck of the can during opening.

The ledge has two possible functions. It firstly acts as a stop when the threaded tubular member is inserted into the neck. It can also act as a rim for engagement with a tamper evident ring around the base of the cap. The ring is adapted to detach from the cap the first time the cap is opened.

The annular gripping ribs are preferably angled in an upward direction so that the threaded plastic sleeve will easily slide down into the open end of the can neck while firmly gripping the inner face of the neck against upward axial movement when under pressure and create a gas tight seal. This may be used together with a bonding agent which is preferably applied to the gripping ribs before inserting the threaded sleeve. The threaded cap may be attached to the threaded sleeve before the sleeve is connected to the can neck.

It is also advantageous to form the top edge of the downwardly turned neck portion into a rounded, e.g. annular, rim which serves as a stiffener for the top end of the neck.

When the threaded sleeve is designed to be mounted over the projecting neck, the annular gripping ribs are on the inside face of the downwardly projecting sleeve and grip the outer face of the neck. The downwardly turned neck portion may be outwardly and downwardly turned and the bottom of the sleeve may optionally include a catch to engage the bottom edge of the downwardly turned portion. With this design, there may be both an outward and an inward projecting ledge, the inward ledge engaging the top of the neck and the outward ledge being adapted to provide tamper evidence as described above.

In any of the above designs, it is also possible to provide a plurality of ribs or projections in the longitudinal (axial) direction on the inner face of the threaded tubular member skirt to bite into the neck or engage with mating ribs or projections on the neck to resist rotation of the threaded tubular member during opening of the can.

The can, including the shoulder and neck portions, may have a variety of cross-sectional shapes. Any shape may be used that is typically produced by procedures such as drawing, redrawing, drawing and ironing, impact extrusion, etc.

BRIEF DESCRIPTION OF THE DRAWINGS

In the drawings which represent the present invention.

DESCRIPTION OF THE PREFERRED EMBODIMENTS

Figure 1:
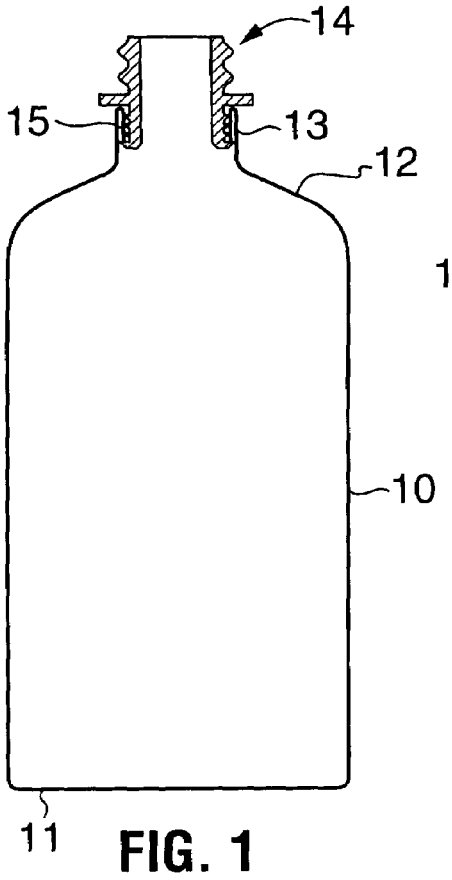
FIG. 1 is a vertical cross section of a typical beverage can according to the invention.

FIG. 1 shows a metal can having a cylindrical sidewall 10, a bottom wall 11, a top shoulder portion 12 and a neck portion 13. The metal used to form the can body is preferably an aluminum alloy in the 3000 series having an initial thickness of about 0.006-0.020 inch, preferably 0.010-0.014 inch.

Figure 2:
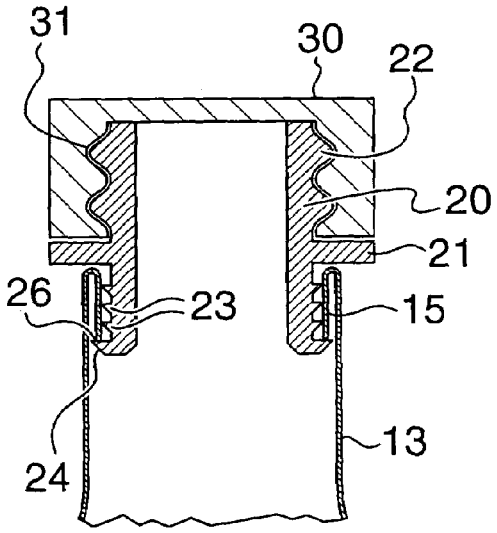
FIG. 2 is a vertical cross section of one embodiment of the can neck and threaded sleeve.

The top portion of the can of FIG. 1 is shown in greater detail in FIG. 2. Thus, the top edge portion of the neck 13 is turned inwardly and downwardly to form a flange portion 15 with a lower edge 26 providing an abutment.

A threaded plastic sleeve 14 is mounted in the neck 13, this sleeve being in the form of an open ended tubular member 20 having an annular ledge 21 projecting outwardly from a mid-region of its outer face. The outer face above the projecting ledge 21 comprises a threaded portion 22 adapted to receive the internal threading 31 of closure cap 30. The outer face of tubular member 20 below the projecting annular ledge 21 comprises a plurality of axially spaced annular gripping ribs which securely engage the inner face of the flange 15 and also included is a lowermost catch 24 which engages the flange abutment 26 to hold the sleeve 20 against axial movement relative to the can neck 13.

Figure 3:
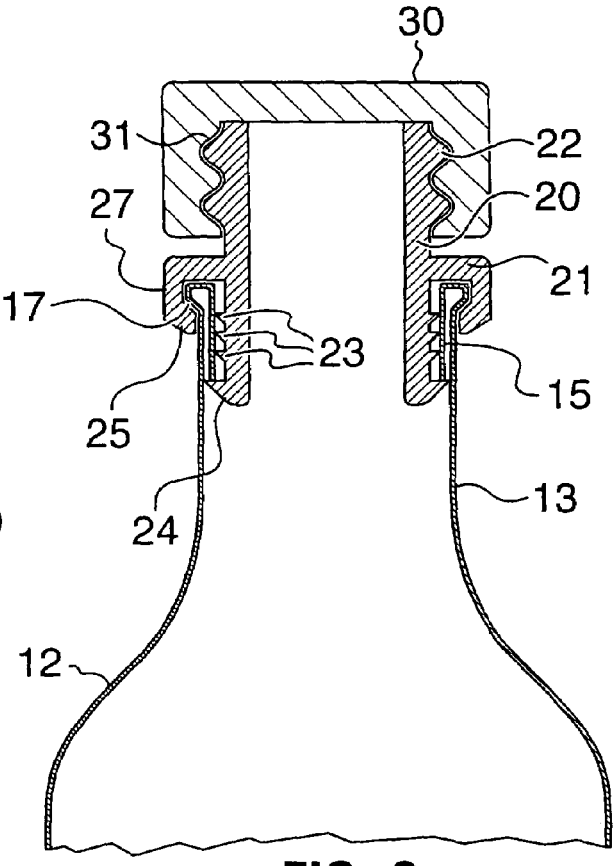
FIG. 3 is a further vertical cross section of the can neck and plastic sleeve.

An alternative embodiment is shown in FIG. 3. In this arrangement, a skirt portion 27 extends downwardly from the annular ledge 21 outside the can neck 13, such that the top end of the neck is held in an annular groove. The folding of the neck 13 to form flange 15 includes an outwardly rounded rim portion 17. This rounded rim portion provides stiffening for the neck as well as an abutment to engage the inwardly directed lip 25 at the bottom edge of skirt portion 27. This helps to prevent elongation growth of neck 13 caused by the flange 15 unfurling as the internal pressure pushes against the closure cap 30.

In the same manner as FIG. 2, the ribs 23 bite into the adjacent can metal to provide a gas-tight seal, and the catches 24 engage the abutments 26 to prevent the plastic sleeve from being ejected under gas pressure. The combination of the gripping ribs 23, the catches 24 and the skirt portion 27 engaging the rounded rim 17 of the can neck provide an overall secure attachment of the threaded plastic sleeve 14 to the can neck 13.

Figure 4:
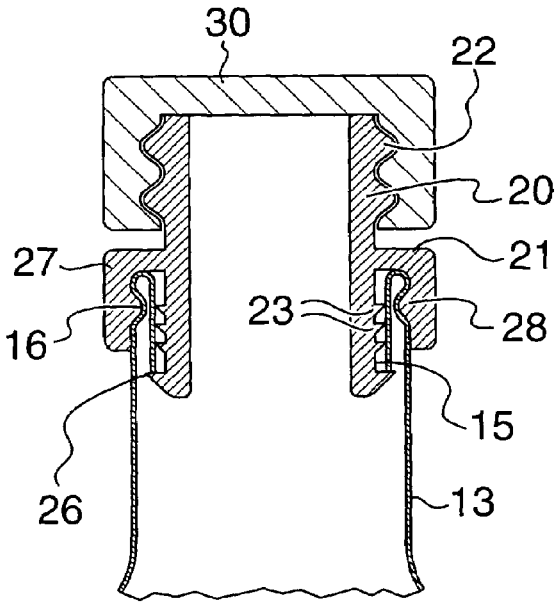
FIG. 4 is a still further vertical cross section of another embodiment of the can neck and threaded plastic sleeve.

FIG. 4 is a modification of the design of FIG. 3 with a different gripping arrangement between the annular ledge skirt 27 and the neck portion 13. In this embodiment, the neck portion has an annular indentation 16 which engages a mating annular projection 28 on the inner face of the skirt portion 27.

Figure 5:
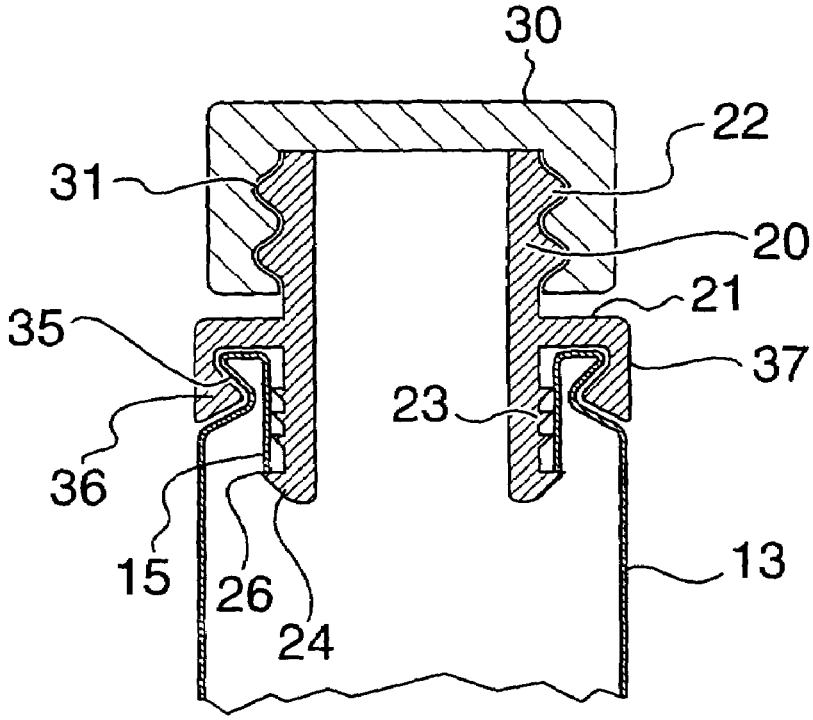
FIG. 5 is a vertical cross section of an embodiment in which the plastic sleeve is flush with the can neck.

It is desirable for customer appeal to have a bottle shape with clean lines where the outer surface of the cap and sleeve are flush with the outer surface of the neck portion. An example of this can be seen in FIG. 5, where the bottle neck has an indented upper portion 35, such that skirt portion 36 mates with the indented portion 35 with the outer face 37 of skirt portion 36 flush with the outer face of neck portion 13. The remainder of this design is similar to FIGS. 3 and 4.

Figure 6:
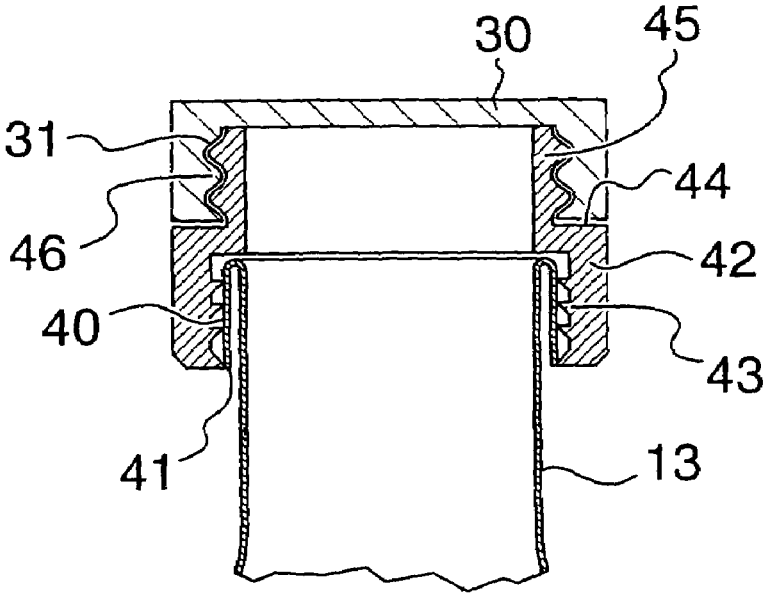
FIG. 6 is a vertical cross-section of an embodiment in which the threaded sleeve fits over the can neck.

FIG. 6 shows a design in which the threaded plastic sleeve is mounted over the protecting neck. In this design, a portion 40 of the can neck is turned outwardly and downwardly providing an abutment 41. The threaded sleeve has a lower tubular portion 42, with a plurality of axially spaced annular gripping ribs 43 extending inwardly from the inner face of tubular portion 42. These grip the face of the neck in the same manner as described hereinbefore. At the top of the lower tubular portion is a ledge 44 which projects both inwardly and outwardly. Extending up from ledge 44 is an upper tubular portion 45 with external threads 46, adapted to receive the internal threading 31 of closure cap 30.

The invention claimed is:

1. A reclosable beverage container comprising: (a) a metal beverage can made from a thin gauge metal, comprising a sidewall, a bottom wall, a converging shoulder portion extending upwardly and inwardly from said sidewall, a neck on top of said shoulder portion, said neck having a top edge portion turned downwardly to form a flange with a lower edge providing an abutment, (b) a closure cap having an inner surface including an internal thread, and (c) a threaded plastic sleeve mounted in coaxial overlapping relation to said neck, said sleeve comprising an open-ended tubular member having an annular ledge projecting laterally from a mid-region of the tubular member, an outer face above the projecting ledge being engageable with the inner surface of the closure cap to constitute therewith a reclosable seal for the container with at least a portion of the outer face comprising a threaded portion adapted to receive the internally threaded closure cap, and a portion of the tubular member below the projecting ledge having at the lower end thereof an annular catch adapted to slide downwardly over the flange and latch over the flange lower edge abutment against axial movement, and including a plurality of axially spaced annular gripping ribs located between the annular catch and the projecting ledge, said gripping ribs securely engaging the exposed face of the flange and being angled upwardly and adapted to slide downwardly along the flange while gripping the flange face against upward movement relative thereto, and an annular skirt projecting downwardly from the outer edge of said annular ledge, said skirt extending downwardly and in engagement with the outer face of the can neck, with an inward projection on the skirt engaging an abutment on the can neck against relative axial movement, wherein the threaded plastic sleeve is adapted to be joined with the can neck by being pushed axially into the open end of the neck and wherein a bonding agent is provided between the engaging faces of the sleeve and the can neck.

* * * * *